United States Patent [19]

Tsukamoto et al.

[11] Patent Number: 4,857,938

[45] Date of Patent: Aug. 15, 1989

[54] PLANAR ANTENNA

[75] Inventors: Katsuya Tsukamoto; Yasuhiro Fujii; Toshio Abiko, all of Kadoma, Japan

[73] Assignee: Matsushita Electric Works, Ltd., Osaka, Japan

[21] Appl. No.: 247,082

[22] Filed: Sep. 21, 1988

[30] Foreign Application Priority Data

Oct. 15, 1987 [JP] Japan ..... 62-260032

[51] Int. Cl.[4] ..... H01Q 1/38

[52] U.S. Cl. ..... 343/700 MS; 343/846

[58] Field of Search ..... 343/700 MS, 767, 770, 343/768, 771, 829, 846

[56] References Cited

U.S. PATENT DOCUMENTS 4,486,758 12/1984 deKonde ..... 343/700 MS 4,590,478 5/1986 Powers et al. ..... 343/700 MS

FOREIGN PATENT DOCUMENTS 47105 4/1981 Japan ..... 343/771

OTHER PUBLICATIONS

Shone, "Horizontally-polarised pole aerial for medium-power VHF transmitting stations", Rev. HF(Belgium), vol. 8, No. 1 (1970).

*Primary Examiner*—Rolf Hille

*Assistant Examiner*—Michael C. Wimer

*Attorney, Agent, or Firm*—Burns, Doane, Swecker & Mathis

[57] ABSTRACT

A planar antenna is formed by providing a radiation circuit with a plurality of pairs of radiation elements respectively formed by a slot made in a conductive layer and having a patch element disposed in the slot, the radiation elements in each pair being in mutually positional relationship rotated by 90 degrees and different dimensional relationship, and electromagnetically coupling the respective radiation elements through power supply terminals with a power-supply circuit mutually with a phase difference of 90 degrees in each pair for a power supply between the both circuits, whereby the antenna is expanded in service band and increased in the cross polarization characteristics.

5 Claims, 3 Drawing Sheets

PLANAR ANTENNA

TECHNICAL BACKGROUND OF THE INVENTION

This invention relates generally to planar antennas and, more particularly, to a planar antenna for use with circularly polarized waves and excellent in cross polarization characteristics over a wide band.

The planar antennas of the kind referred to are effectively utilized in receiving, without radio interference, circularly polarized waves transmitted as carried on SHF band, in particular, 12 GHz band from a geostationary broadcasting satellite launched into cosmic space to be 36,000 Km high from the earth.

DISCLOSURE OF PRIOR ART

While parabolic antennas erected on the roof or the like positions of house buildings have been generally utilized an antenna for receiving the circularly polarized waves from the geostationary satellite, the parabolic antennas have been defective in that they are susceptible to strong wind to easily fall down due to their bulky three dimensional structure so that additional means for stably supporting them will have to be employed, and that such supporting means further requires high mounting costs and still troublesome installation labor.

In attempt to eliminate these problems of the parabolic antennas, there has been suggested in Japanese Patent Application Laid-Open Publication No. 99803/1982 (corresponding to U.S. Pat. No. 4,475,107 or German Offenlegungsschrift No. 314900.2) a planar antenna which is flattened in the entire configuration, according to which the structure can be much simplified and it is made possible to directly mount the antenna on an outdoor wall or the like position of the house buildings so as to be made inexpensive.

Further, the planar antenna has been demanded to be of a high gain, for which purpose various attempts have been made to reduce insertion loss. Disclosed in, for example, U.S. patent application Ser. No. 15,009 of K. Tsukamoto et al (to which U.K. Patent Application No. 87 03640, German Patent Application P 37 06 051.1 or French Patent Application No. 87 02421 corresponds) prior to the present invention is a planar antenna, in which power-supply circuit and radiation circuit are not connected directly to each other but are electromagnetically coupled for supplying a power from the power-supply circuit to the radiation circuit, while the both circuits as well as an earthing conductor are respectively carried on each of insulating plates which are separated from one another by means of a space retaining means. With this arrangement, therefore, the power supply circuit can be also disposed in the space thus retained so as to minimize the loss to improve the assembling ability, and the insertion loss can be effectively lowered.

Further prior to the present invention, there has been suggested in U.S. patent application Ser. No. 88,265 of T. Abiko et al (to which U.K. Patent Application No. 87 19750, German Patent Application P 37 29 750, or French Patent Application No. 87 12274 corresponds) another planar antenna in which a radiation circuit is provided with many slots in respective which each of patch elements is disposed, and such radiation circuit is electromagnetically coupled at the patch elements in the slots to opposed power supply terminals of a power supply circuit, so as to further decrease the loss while incrementally improving the assembling ability.

According to the foregoing two prior art, it is possible to reduce the insertion loss and to improve the assembling ability for rendering the antenna to be highly mass-produceable, whereas the service band is generally below 300 Hz and the cross polarity characteristics are kept only to be about 20dB, and their planar antennas have been demanded to be improved in this respect.

FIELD OF ART

A primary object of the present invention is, therefore, to provide a planar antenna which is capable not only of retaining a high antenna gain and excellent assembling ability, but also of expanding the service band and remarkably improving the cross polarity characteristics.

According to the present invention, this object of the invention can be attained by means of a planar antenna for receiving polarized waves transmitted as carried on SHF band from a satellite, in which radiation and power-supply circuits respectively of a conductive material and earthing conductor are disposed to be independent of one another with a layer of dielectric material interposed between them, the radiation circuit comprises radiation elements each including a slot in which a patch element is disposed, and the patch elements of the radiation circuit are electromagnetically coupled to power-supply terminals of the power-supply circuit, the antenna being featured in that the radiation elements in the radiation circuit are arranged in a pair in which the radiation elements are in mutually positional relationship rotated by 90 degrees and different dimensional relationship, and the radiation elements in the pair are supplied with a power through the power-supply terminals of the power-supply circuit mutually with a phase difference of 90 degrees.

Other objects and advantages of the present invention shall be made clear in following description of the invention detailed with reference to preferred embodiments shown in accompanying drawings.

Figure 1:
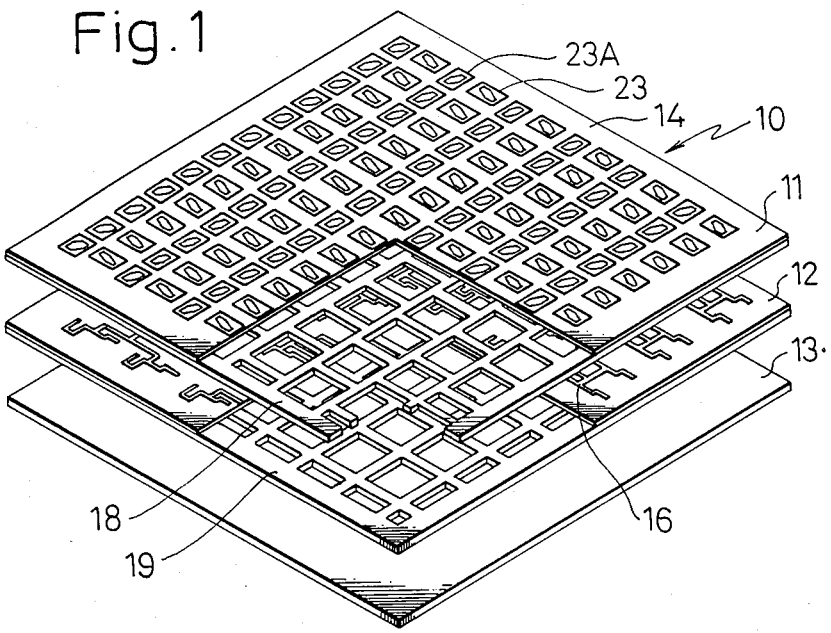
FIG. 1 shows in a perspective view an embodiment of the planar antenna according to the present invention, with its constituents shown as disassembled from one another and partly as omitted.

While the present invention shall now be explained with reference to the various embodiments shown in the drawings of the invention, it should be appreciated that the intention is not to limit the invention only to these embodiments shown but to rather include all modifications, alterations and equivalent arrangements possible within the scope of appended claims.

DISCLOSURE OF PREFERRED EMBODIMENTS

Referring to FIGS. 1 to 4, a planar antenna 10 according to the present invention generally comprises a radiation circuit plate 11, a power-supply circuit plate 12 and an earthing conductor plate 13. The radiation circuit plate 11 includes a radiation circuit network 14 of a layer of such conducting material as copper, aluminum, astatine, iron, gold and the like formed on a surface of a synthetic resin layer 15 and, if required, coated with a synthetic resin over the top surface. The power-supply circuit plate 12 includes a power-supply circuit network 16 of a layer of the same conducting material as that for the radiation circuit network 14 also formed on a surface of a synthetic resin layer 17 and, if required, coated with a synthetic resin over top surface. The earthing conductor plate 13 is formed as a whole, for example, by the same material as the radiation circuit network 14 and, if required, covered by a synthetic resin over top and bottom surfaces.

Figure 4:
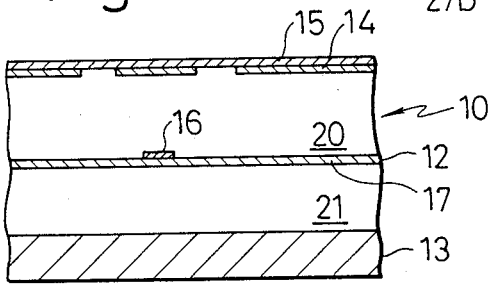
FIG. 4 is a fragmentary sectioned view as magnified of the planar antenna shown in FIG. 1.
Figure 2:
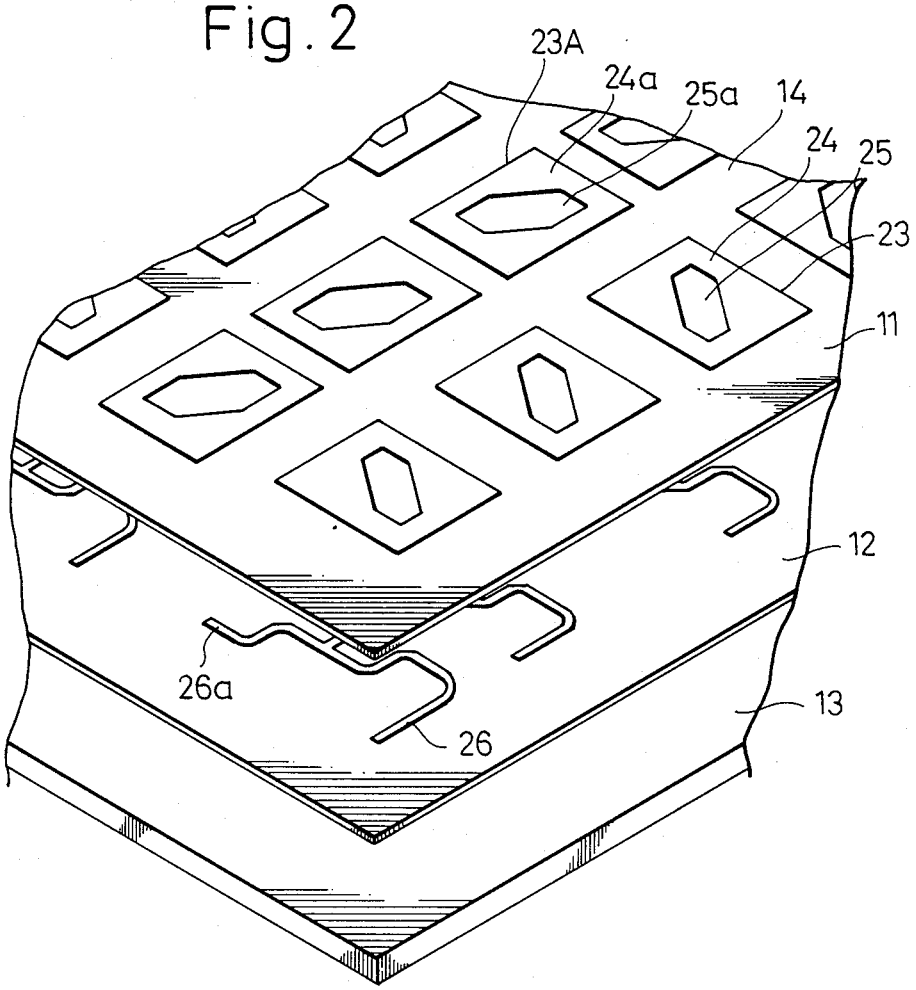
FIG. 2 is a fragmentary perspective view as magnified of the planar antenna of FIG. 1.

Between the radiation circuit plate 11 and the power-supply circuit plate 12, as well as between the power-supply circuit plate 12 and the earthing conductor plate 13, there are properly interposed such space retaining means as spacers 18 and 19 of, for example, a synthetic resin, optimumly a foamed resin, which is formed into such a lattice shape as shown in FIG. 1 so as to define spaces 20 and 21 as seen in FIG. 4. In this case, a gas, in particular, air is present in the spaces 20 and 21 so as to act as a low loss dielectric member.

On or above the top surface, or front face acting as an antenna surface of the planar antenna 10, if required, there may be provided a radome made mainly of a foamed plastic permeable to electric waves so as to cover and protect the surface, taking into consideration a possible outdoor installation of the antenna. With this covering by the radome, not only the antenna surface but also the entire planar antenna 10 may be made to have a good strength, and it is made possible to effectively prevent the height of the spaces 20 and 21 from being decreased.

Figure 3:
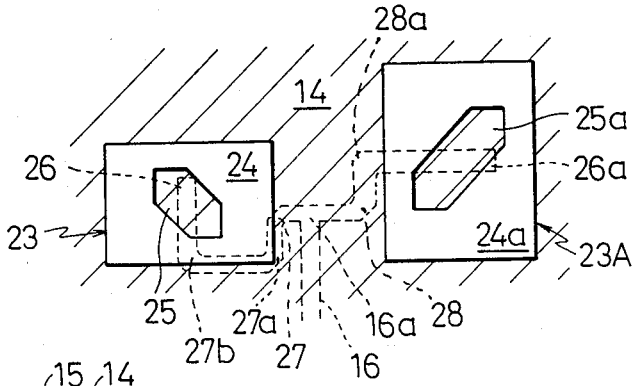
FIG. 3 is a fragmentary plan view of the planar antenna of FIG. 1, as magnified.

The radiation circuit network 14 on the radiation circuit plate 11 comprises many radiation elements which are formed in the present invention in a plurality of pairs of the radiation elements 23 and 23A. Further, as shown in detail in FIG. 3, the radiation elements 23 and 23A in the respective pairs comprise a pair of slots 24 and **24*a* made in the conducting layer of the radiation circuit network 14, and also a pair of patch elements 25 and 25*a* disposed respectively in each of the slots 24 and 24*a*. Further, the pair of the radiation elements 23 and 23A are arranged so that one of the elements is rotated by 90 degrees with respect to the other element in rotating direction of polarization plane of the circularly polarized waves, and is made different in the dimensions, while the elements 23 and 23A are electromagnetically coupled respectively with each of a pair of power-supply terminals 26 and 26*a* in the power-supply circuit network 16 on the power-supply circuit plate 12. More specifically, the slot 24 and patch element 25 disposed in this slot 24 of the radiation element 23, assumed here to be on the side delayed in the phase in the rotating direction of the polarization plane of the circularly polarized waves i.e. temporally behind patch element 25A with respect to the rotation of the circularly polarized waves, are formed smaller preferably by about 1 to 7% in area ratio than the slot 24*a* and patch element 25*a* of the other radiation element 23A on the side advanced in the phase. In this case, the slots 24 and 24*a* which are rectangular in the present instance are so disposed that, as shown in FIG. 3, the slot 24 of one 23 of the paired radiation elements will lie horizontal with its longitudinal axis while the slot 24*a* of the other radiation element 23A will lie vertical with its longitudinal axis and will be larger in the area than the slot 24. Further, the both patch elements 25 and 25*a* are made to be of an elongated hexagonal shape in the present instance as formed by cutting two diagonally opposing corners of a square shape conductor layer disposed substantially in the center of the slot 24 or 24*a*, and the patch element 25*a* of the radiation element 23A is made larger in the surface area than the patch element 25 in the radiation element 23**.

The power-supply terminals 26 and **26*a* of the power-supply circuit network 16 are so arranged, in addition to their electromagnetic coupling respectively with opposing one of the patch elements 25 and 25*a* in the radiation elements 23 and 23A, that they will execute the power supply to the paired radiation elements 23 and 23A with a phase difference mutually at 90 degrees. Thus, the power-supply terminals 26 and 26*a* extend on the power-supply circuit plate 12, as shown by dotted lines in FIG. 3 as seen from above the radiation circuit network 14, so as to lie substantially across the center of the opposing slots 24 and 24*a* to reach a position overlapping with the both patch elements 25 and 25*a* in the thickness direction of the antenna 10. More specifically, one power-supply terminal 26 is extended from a T-shaped branch part 16*a* of the power-supply circuit network 16 as bent three times to be U-shaped, while the other power-supply terminal 26*a* is extended also from the branch part 16*a* in opposite direction to the terminal 26 as bent twice to be L-shaped. It has been found preferable in minimizing the transmission loss that, in respective bent parts 27, 27*a* and 27*b* of the terminal 26 as well as bent parts 28 and 28*a* of the other terminal 26*a*, other bent parts 27, 27*a* and 28 than the furthest positioned bent parts 27*b* and 28*a* closer to extended ends of the respective terminals 26 and 26*a*** are rounded at inside bent edge but diagonally straightened at outside bent edge.

Figure 5:
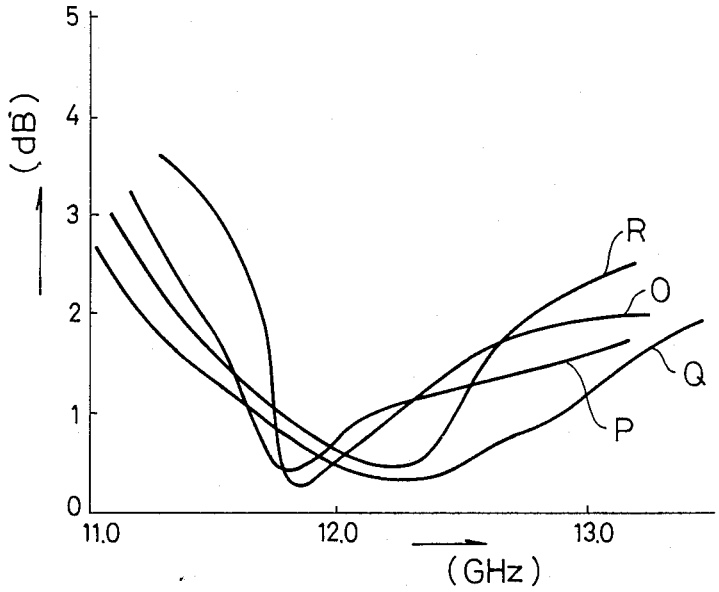
FIG. 5 is a diagram showing respective measurements of axial ratios of the paired radiation elements in four different cases with the dimensions varied.

Axial ratio representing the circularly polarized wave characteristics has been measured in respect of sample radiation circuit networks in which, with respect to one radiation element 23, the other radiation element 23A is varied in size to be larger by 0%, 1%, 4% and 7%, the measurement of respective which samples being denoted by curves 0, P, Q and R, respectively, in FIG. 5, and it should be appreciated that the latter three samples of the curve P, Q and R show smaller values of the axial ratio than that of the first sample of the 0% dimensional difference and thus remarkably improved circularly polarized wave characteristics, whereby the service band width can be eventually expanded. In practice, it has been found that, by properly setting the mutual dimensional relationship between the both radiation elements 23 and 23A, a gain fluctuation can be made to be ±0.3dB and an axial ratio fluctuation can be made ±0.5dB over a wide range of 800 MHz.

EXAMPLE 1

The radiation circuit network 14 was formed on a flexible circuit print board available in the market, in which network the slots 24 respectively of a longer side of 15 mm and a shorter side of 13 mm as well as the patch elements 25 respectively of a hexagonal shape made by cutting off two diagonal corners of a square shape of each side of 8 mm in the slots 24 were formed by means of an etching process. The other radiation elements 23A were formed in the rotated relationship with respect to the radiation elements 23 by 90 degrees in the rotating direction of the polarization plane and with an increment substantially of 5% in the dimensions. In other words, an axial line of the radiation elements 23A forms a 90 degree angle with the axial line of radiation elements 23 and the radiation elements 23 appear before the radiation elements 23A in the direction of rotation of a plane containing the polarized waves, wherein radiation elements 23A are 5% larger in dimension than radiation elements 23 with respect to both slot and patch elements. These radiation elements 23 and 23A were formed in 28 pairs on the flexible board. The power-supply circuit network 16 was prepared on the same type of the flexible circuit print board as that of the radiation circuit network 14 by means of the etching process, so that the terminals 26 and **26*a* would extend in the U-shape and L-shape, respectively, from the T-shaped branch parts 16*a*, for the electromagnetic coupling with the respective paired radiation elements 23 and 23A with the phase difference of 90 degrees. The earthing conductor plate 13 was prepared with an aluminum plate of 2 mm thick available in the market, and a planar antenna was prepared by stacking on the earthing conductor plate 13 the power-supply circuit plate 12 having the power-supply circuit network 16 and the radiation circuit plate 11 having the radiation circuit network 14**, with a foamed polyethylene sheet interposed as the spacer of the dielectric layer.

With this planar antenna, a gain of 31.5±0.2dBi at an axial ratio of 0.9±0.4dB could be achieved at a service band of 11.7 to 12.2GHz.

EXAMPLE 2

A planar antenna was prepared in the same manner as in the foregoing EXAMPLE 1, except for that a honeycomb or lattice shaped foamed polyethylene sheet having many cavities was employed as the dielectric layers.

With this planar antenna, a service band expansion could be realized to be 11.6 to 12.4GHz.

EXAMPLE 3

A planar antenna was prepared in the same manner as in the foregoing EXAMPLE 1, except for that the spacers 18 and 19 both of a frame shape rendering the spaces 20 and 21 continuous over the respective circuit-formed zones of the plates 11 and 12 were employed instead of the foamed polyethylene sheet, between the radiation circuit and power-supply circuit plates 11 and 12 and between the power-supply circuit plate 12 and the earthing conductor plate 13.

With this planar antenna 10, too, the same characteristics as in the foregoing EXAMPLE 2 could be obtained.

Figure 6:
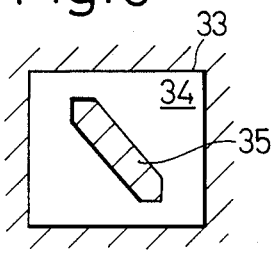
FIGS. 6 through 10 are fragmentary plan views of the radiation element in various other aspects in the planar antenna according to the present invention.
Figure 7:
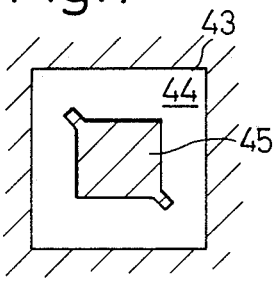
Figure 8:
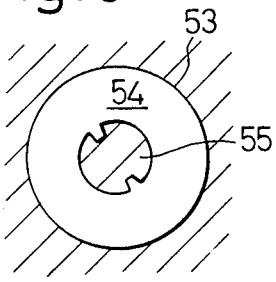
Figure 9:
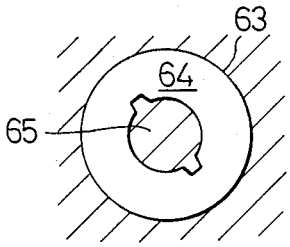
Figure 10:
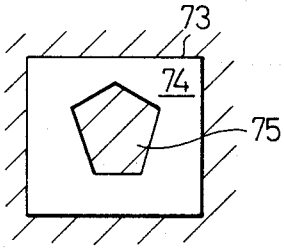

In the radiation element, either the slot or the patch element or both can be formed in various shapes. As shown, for example, in FIG. 6, a patch 35 disposed in a rectangular slot 34 of a radiation element 33 may be made thinner than in the case of the foregoing embodiment. As in FIG. 7, a radiation element 43 may have a slot 44 of a square shape, and a patch element 45 also of a square body having diagonally upward and downward extended corners may be provided in such slot 44. As in FIG. 8, a slot 54 and a patch 55 therein made may be both of circular shape while the circular patch 55 is provided with a pair of diametrally opposing notches. In the case of FIG. 9, a circular patch 65 provided in a circular slot 64 may be provided with a pair of diametrally opposing projections. As shown in FIG. 10, further, a radiation element 73 of a square slot 74 may be provided with a pentagonal patch 75 with a corner directed to the center of an adjacent side of the square slot 74.

For the power-supply terminals 26 and **26*a* of the power-supply circuit network 16, any other formation than that described may be employed so long as the power supply to the respective pairs of the radiation elements 23 and 23A with the phase difference of 90** degrees can be attained, while it has been found that the foregoing formation in which the terminals are sequentially bent substantially at right angles is effective in that the thus bent terminal portions in the power-supply circuit network act as if they are a part of the radiation circuit network, and excellent circularly polarized wave receiving characteristics are shown.

What we claim as our invention is:

1. A planar antenna for receiving polarized waves transmitted as carried on SHF band from a satellite, the antenna comprising a radiation circuit of a conductive material and including a plurality of pairs of radiation elements each of said radiation elements comprising a slot made in said conductive material and a patch element disposed in said slot, one of said radiation elements in each of said pairs being rotated by 90 degrees relative to and made different in dimensions from the other radiation element with respect to both the slot and patch elements, a power-supply circuit including power-supply terminals respectively opposed to each of the patch elements of said radiation elements in a plane adjacent a plane of said radiation circuit and electromagnetically coupled to each patch element, said power-supply terminals supplying power to each of said radiation elements of each pair at a phase difference of 90 degrees, and an earthing conductor, wherein said radiation and power-supply circuits and said earthing conductor are respectively disposed to be independent of one another with a layer of dielectric material interposed between each of them.

2. An antenna according to claim 1, wherein one of said radiation elements in each of said pairs is delayed in phase in a rotating direction of a polarization plane of circularly polarized waves, relative to the other of said radiation elements of said pair and is made smaller than the other radiation element.

3. An antenna according to claim 2, wherein said one of said radiation elements is formed to be smaller substantially by 1 to 7% than the other radiation element.

4. An antenna according to claim 1, wherein said power-supply terminals of said power-supply circuit extend in a plane of the power-supply circuit and are sequentially bent to respectively cross each slot to oppose each patch elements.

5. A planar antenna for receiving polarized waves transmitted as carried on SHF band from a satellite, the antenna comprising a radiation circuit of a conductive material and including a plurality of pairs of radiation elements each of said rotation elements comprising a slot made in said conductive material and a patch element disposed in said slot, one of said radiation elements in each of said pairs being rotated by 90 degrees relative to and made different in dimensions from the other radiation element in a direction opposite to the rotation direction of a polarization plane of circularly polarized waves, a power-supply circuit including power-supply terminals respectively opposed to each of the patch elements of said radiation elements in a plane adjacent said radiation circuit and electromagnetically coupled to each patch element, said power-supply terminals supplying power to each of said radiation elements of each pair at a phase difference of 90 degrees, wherein said power-supply terminals in said power-supply circuit are provided in pairs, in each of which one of the terminals is extended from a T-shaped branch part of the power-supply circuit to extend a bent in a U-shape to be electromagnetically coupled to said one radiation element, and the other terminal is extended from said T-shaped branch part to extend as bent in an L-shape to be electromagnetically coupled to said other radiation element, and an earthing conductor, wherein said radiation and power-supply circuits and said earthing conductor are respectively disposed to be independent of one another with a layer of dielectric material interposed between each of them.

* * * * *